US006129020A

United States Patent [19]

Speck

[11] Patent Number: 6,129,020

[45] Date of Patent: Oct. 10, 2000

[54] AIR EXHAUST DEVICE FOR PRINTING MACHINES

[75] Inventor: Ulrich Speck, Ludwigsburg, Germany

[73] Assignee: LTG Luftechnische Gesellschaft mit beschrankter Haftung, Germany

[21] Appl. No.: 08/841,158

[22] Filed: Apr. 29, 1997

[30] Foreign Application Priority Data

Apr. 29, 1996 [DE] Germany ..... 196 17 194

[51] Int. Cl.[7] ..... B41F 35/00; B08B 15/02

[52] U.S. Cl. ..... 101/425; 101/480; 454/50; 454/53; 454/56

[58] Field of Search ..... 101/480, 424.1, 101/423, 425; 454/50, 53, 56, 66, 67

[56] References Cited

U.S. PATENT DOCUMENTS

| | | | |
|---|---|---|---|
| 2,096,164 | 10/1937 | Diefenbach | 101/350 |
| 2,710,574 | 6/1955 | Runion | 454/66 |
| 3,851,582 | 12/1974 | Saueressig et al. | 101/424.1 |
| 5,189,477 | 2/1993 | Leys et al. | 399/300 |
| 5,424,806 | 6/1995 | Siegel | 454/49 |
| 5,514,036 | 5/1996 | Lin | 454/184 |
| 5,564,693 | 10/1996 | Elkis et al. | 271/276 |
| 5,643,078 | 7/1997 | Sairanen et al. | 454/66 |

FOREIGN PATENT DOCUMENTS

| | | | |
|---|---|---|---|
| 494113 | 3/1930 | Germany | 101/424.1 |
| 58-089368 | 5/1983 | Japan . | |
| 5-229104 | 9/1993 | Japan . | |
| 1020281 | 2/1966 | United Kingdom . | |

*Primary Examiner*—John S. Hilten
*Assistant Examiner*—Daniel J. Colilla
*Attorney, Agent, or Firm*—Ostrolenk, Faber, Gerb & Soffen, LLP

[57] ABSTRACT

The invention relates to an air exhaust device for printing machines, tin-plate printing machines, varnishing units or the like, in particular for the removal of ink mist, having at least one exhaust element arranged above the rolls of the printing machine, which exhaust element has at least one air exhaust opening. The exhaust element (16) is arranged laterally of the rolls (4) and the air exhaust opening (14) draws the air in in approximately horizontal direction.

28 Claims, 6 Drawing Sheets

AIR EXHAUST DEVICE FOR PRINTING MACHINES

BACKGROUND OF THE INVENTION

The present invention relates to an air exhaust device for printing machines, tin-plate printing machines, varnishing machines or the like, particularly for the exhausting up of the mist of ink, having at least one exhaust element which is arranged above the rolls of the printing machine and has at least one air exhaust opening.

It is known to arrange an air exhaust hood above the rolls of a printing unit of a printing machine. The exhaust hood is connected to a suction device so that the air above the printing unit, and thus, for instance, also the mist of ink formed, etc. is drawn off. The known exhaust hood, to be sure, is at a vertical distance from the printing machine so that an operator has conditional access to the printing rolls, etc., but the access is extremely limited by the exhaust hood, which lies above the region of access. In order to improve the exhaust action it is possible to use vertical screening walls, preferably on three sides, which bridge over the distance between the printing machine and the exhaust hood. These walls can preferably be made of a transparent material, for instance plexiglass. The disadvantage is that while a view of the printing rolls of the printing machine is, it is true, possible if a transparent material is used, direct access however is not assured. If the operator wishes to have access to the rolls, this is possible only through the open side of the screening, which is closed on three sides, and is therefore greatly limited. Even if the screening is removed, the exhaust hood present above the rolls impairs access. Since the known exhaust hood is arranged a corresponding vertical distance above the printing unit of the printing machine, it is necessary to operate with a high suction power in order to remove the mist of ink and the like which is formed. This leads to relatively high air velocities, which have a disadvantageous effect also on the other regions of the place where the printing machine is set up and, for instance, result in the danger of a draft.

SUMMARY OF THE INVENTION

The object of the present invention is therefore to create an air exhaust device of the aforementioned type which, while being of simple construction, permits easy access to the rolls of the printing machine and, furthermore, preferably leaves the other regions of the room air substantially unaffected, so that no disturbing movements of air occur.

This object is achieved in accordance with the invention in the manner that the exhaust element is arranged laterally of the rolls and that the air exhaust opening draws the air in approximately in horizontal direction. In this way, the air present in the region of the rolls is not removed from above as in the prior art, i.e. the air is not drawn off upward, but, as a result of the lateral arrangement of the exhaust element relative to the rolls, there is a removal "towards the side", and therefore approximately in horizontal direction. The invention is, of course, not limited to the horizontal direction but includes of course by the wording "approximately in horizontal direction" also those arrangements in which the exhausting of the air takes place obliquely towards the side. As a whole, there is thus created an arrangement in which the air exhaust opening lies above the rolls and at the same time to the side of them. As a result there is developed a very close association of the exhaust opening with the region to be exhausted, and thus there takes place a direct drawing off above the rolls in horizontal direction, or direction oblique to the horizontal, whereby a very high degree of removal is established. By the lateral arrangement in accordance with the invention, there is furthermore an unrestricted possibility of access to the rolls.

In accordance with a further development of the invention, it is provided that the exhaust element be arranged in the region of the one end of the rolls. It is thus arranged—seen in longitudinal direction of the rolls—at one of their end regions. It is particularly advantageous if two exhaust elements are provided, each arranged in the corresponding end region of the rolls. Thus, a drawing-off takes place on both sides of the printing machine, i.e. the mist of ink or the like is drawn off in part by the one air exhaust opening and in part by the other opposite air exhaust opening. There is thus an arrangement which is integrated in the printing machine on both sides of the printing unit in question.

It is advantageous for at least one exhaust element, and particularly two exhaust elements, to be associated with each printing unit of the printing machine. If the printing machine consists of several printing units, then the exhaust in accordance with the invention takes place at each of these structural units.

The exhaust element is preferably located above the corresponding side wall of the printing machine. The printing machine—in accordance with the customary construction—has two vertical side walls extending parallel to and spaced from each other, between which walls the rolls are located. The exhaust element of the invention is arranged—as mentioned above—above the corresponding side wall. This arrangement is effected, in particular, in the manner that the air exhaust opening is aligned or approximately aligned with the inner surface of the corresponding side wall. In particular, it is provided that the air exhaust element or elements be so arranged that, seen from above, they are not in overlapping position with the rolls. In this way, an optimal possibility of access to the rolls is assured.

Furthermore, it is advantageous for at least one air filter to be associated with the exhaust element. The particle-laden air thus passes through the air filter, whereby the particles with which it is laden are removed, for example, the ink mist is removed. The air filter is preferably replaceable. In particular, it may be so arranged that it extends over the air exhaust opening so that the particles with which the air is laden are removed directly in the air exhaust opening. The air exhaust opening preferably extends over the entire length of the arrangement of rolls—seen in the printing direction—of the printing unit, so that complete coverage is obtained.

The exhaust element is developed in particular as an air chamber, the one side wall of the air chamber being preferably open and the air exhaust opening being formed thereby. Insofar as the air filter is present there, it forms, so to speak, a side wall of the air chamber. As mentioned, the air filter is a replaceable filter. It is preferably received replaceably in a filter cartridge. In particular, the air filter may be a filter mat.

In accordance with a further development of the invention, a hood which extends over the exhaust zone is provided. It thus forms an ink-mist hood with respect to the ink mist produced. The hood is so developed that it forms an air guide device and thus affects the stream of exhaust air in such a manner that it imparts the streams of air a preferred direction and furthermore assures a high degree of coverage. The hood can, for instance, be formed by a protective grid which also exerts an air guidance function. This means that the protective grid, on the one hand, forms protection against contact and, on the other hand, as a result of the grid structure selected, affects the stream of exhaust air, i.e. the grid represents a given resistance (coefficient of resistance) for the air, so that the air guidance function is established. As an alternative, instead of the grid, there can also be used a solid-surface material, which is preferably transparent.

It is furthermore advantageous for the hood to have a top wall which extends between two exhaust elements located opposite each other. The top wall thus forms a continuous screening zone between the opposite exhaust elements which are arranged on both sides of the ends of the printing rolls. The hood can preferably be of U-shaped development, the web of the U forming the top wall and the legs of the U forming hood side walls which extend in the lengthwise direction of the rolls and overlap the arrangement of rolls or a part thereof in vertical direction. Thus the relevant exhaust region is covered in hood-like manner, the removal taking place at least on one or two sides.

It is furthermore advantageous for a perforated-plate arrangement for the development of a uniform exhaust to be present in the air chamber. The perforated-plate arrangement thus has the object of assuring an approximately uniform removal over the entire cross section of the air exhaust opening.

Finally, it is advantageous for the air chamber to be connected to a source of vacuum via an upward extending suction line. The removal thus takes place towards the top of the space in which the printing machine is located.

Other features and advantages of the present invention will become apparent from the following description of the invention which refers to the accompanying drawings.

BRIEF DESCRIPTION OF THE DRAWINGS

One embodiment of the invention is shown in the drawings, in which.

DETAILED DESCRIPTION OF THE INVENTION

Figure 1:
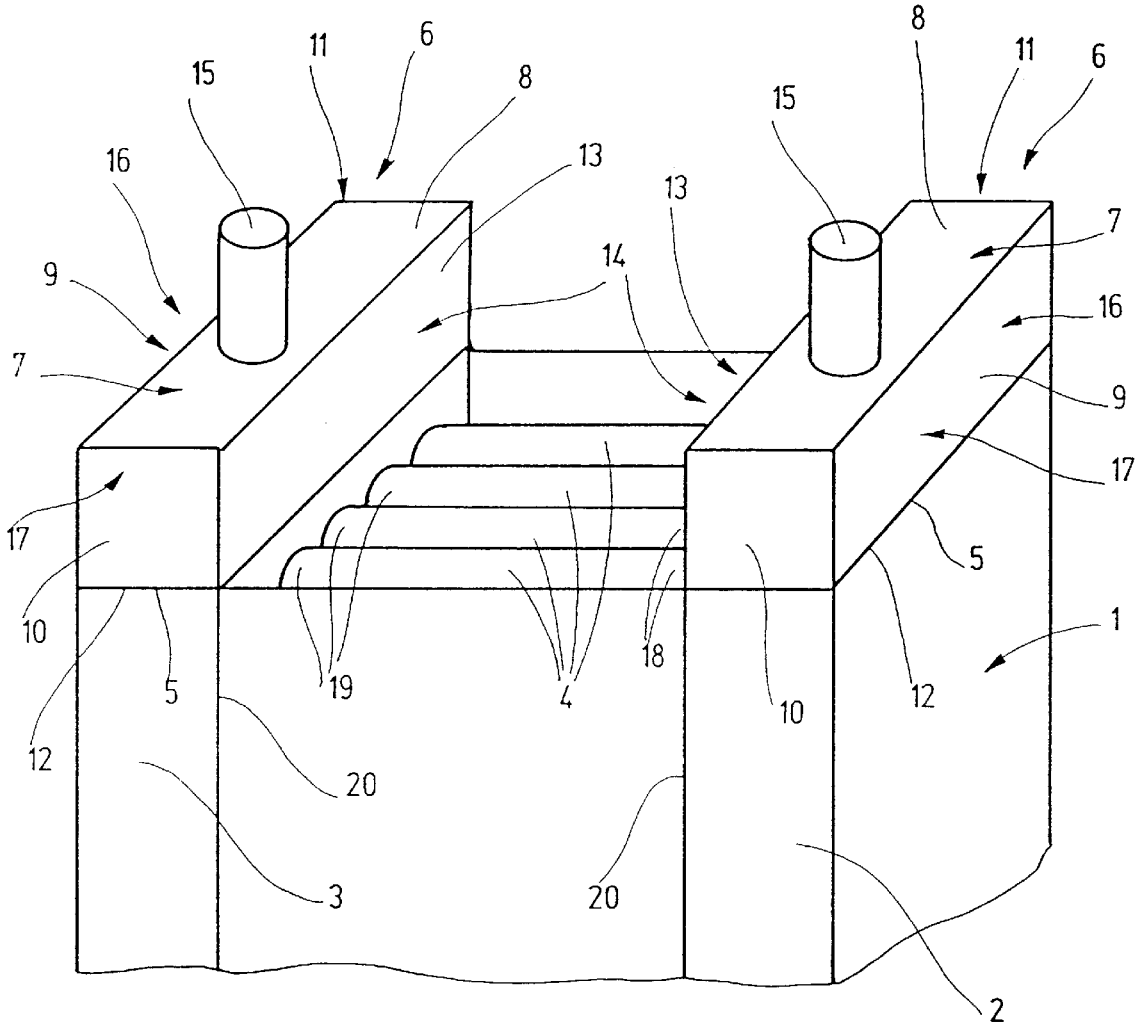
FIG. 1 is a diagrammatic view, in perspective, of a printing unit provided with air exhaust device of a printing machine.

FIG. 1 shows a printing unit 1 of a printing machine, not shown in detail. The printing unit 1 has a first side wall 2 and a second side wall 3. The two side walls 2 and 3 are parallel to and spaced from each other. They extend vertically and receive the bearings and the like of rolls 4 of the printing unit 1. The rolls 4 have horizontally extending axes of rotation and serve for the carrying out of the printing process effected by the printing machine. Rolls 4 can include, for instance, inking rolls, impression rolls or backup rolls. In the operation of the printing machine the air present above the rolls 4 is enriched with particles, for instance with an ink mist. In the following the expression "ink mist" will be used in all cases, but the exhaust does not cover merely particles of ink but all substances with which the air is laden.

Above each of the end surfaces 5 of the side walls 2 and 3 of the printing unit 1 there is an air exhaust device 6. In accordance with another embodiment, not shown, integration of the air exhaust device 6 into one or both side walls 2, 3 is also possible. In the following, only one air exhaust device 6 will be discussed, since the corresponding other one is of similar construction.

The air exhaust device 6 has a suction box 7 which has a top wall 8, a rear wall 9, end walls 10 and 11 and a bottom wall 12. The walls are preferably made of sheet metal. The side 13 of the suction box 7 which is opposite the rear wall 9 is open, whereby an air exhaust opening 14 is formed. Into the top wall 8 there debouches a pipe connection 15 which is connected with a suction line (not shown) which leads to a source of vacuum (not shown).

The suction box 7 thus forms an exhaust element 16 which is developed as air chamber 17, connected via the pipe connection 15 and the exhaust line to the source of vacuum. The exhaust element 16 is located above the corresponding side wall 2 and is therefore placed laterally of the rolls 4, namely in the region of the one end 18 of the rolls 4. In the region of the other end 19 of the rolls 4, another exhaust element 16 of the air exhaust device 6 is arranged, also above the corresponding side wall 3.

The air exhaust device 6 or the two air exhaust devices 6 are thus located above the rolls 4, namely, as mentioned, to be side of the rolls 4 so that, in operation, the air is drawn in in approximately horizontal direction above the rolls through the air exhaust opening 14 or the corresponding air exhaust opening 14. In this way, there is obtained a drawing-off of the air directly in the region where the lading substances are produced, whereby substantially complete coverage is obtained. When two air exhaust devices 6 are present—as shown in FIG. 1—an approximately 50% removal is effected by each air exhaust device 6; in other words, the one device evacuates the right-hand half and the other device the left-hand half of the rolls 4. It can furthermore be noted from FIG. 1 that the corresponding air exhaust opening 14 is aligned with the inner surface 20 of the corresponding side wall 2 or 3. Thus, the exhaust element 16 or exhaust elements 16 is/are so arranged that it/they are not in overlapping position with the rolls 4, as seen from above.

Figure 2:
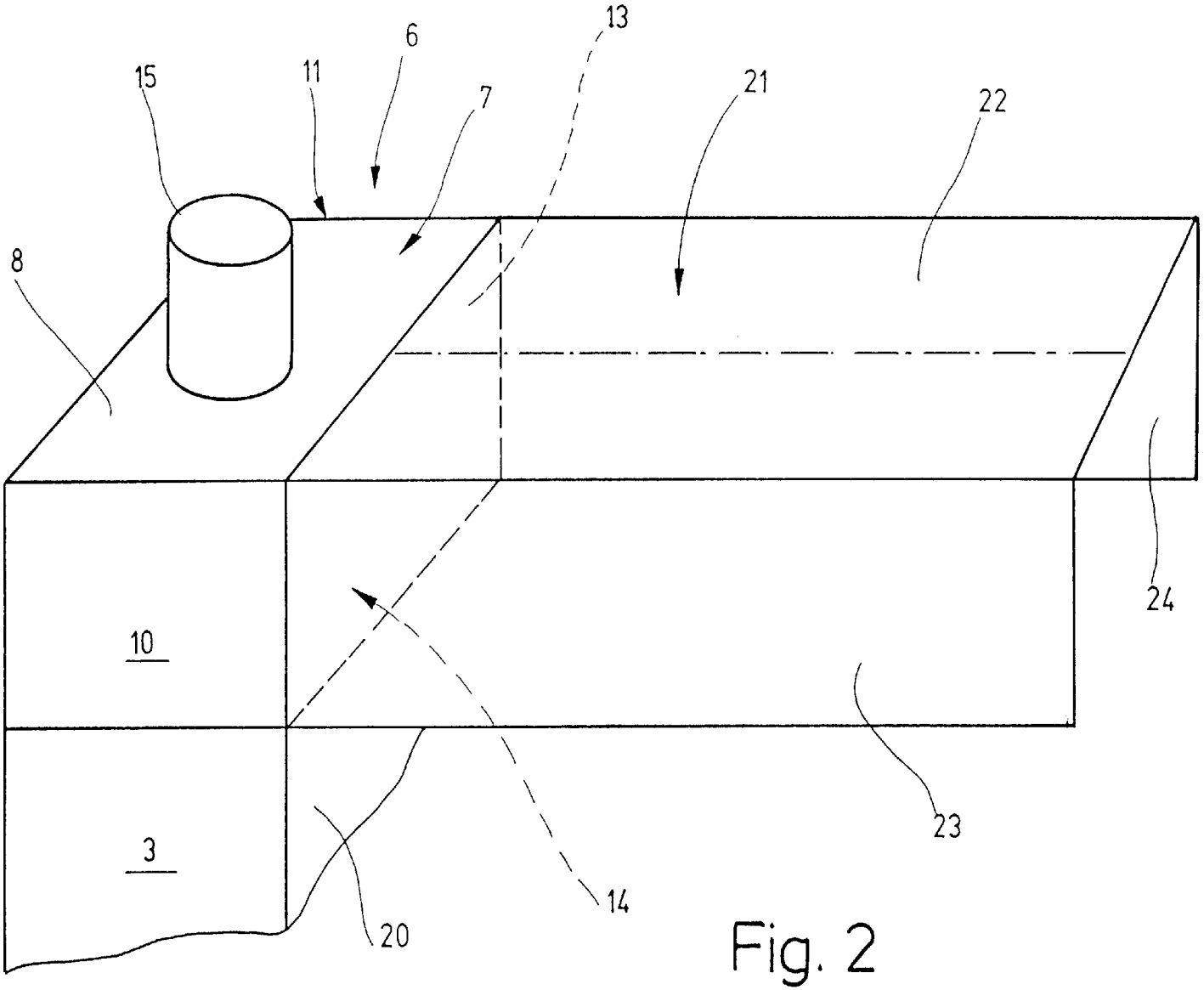
FIG. 2 is a detail view of the arrangement in accordance with FIG. 1, with hood.
Figure 3:
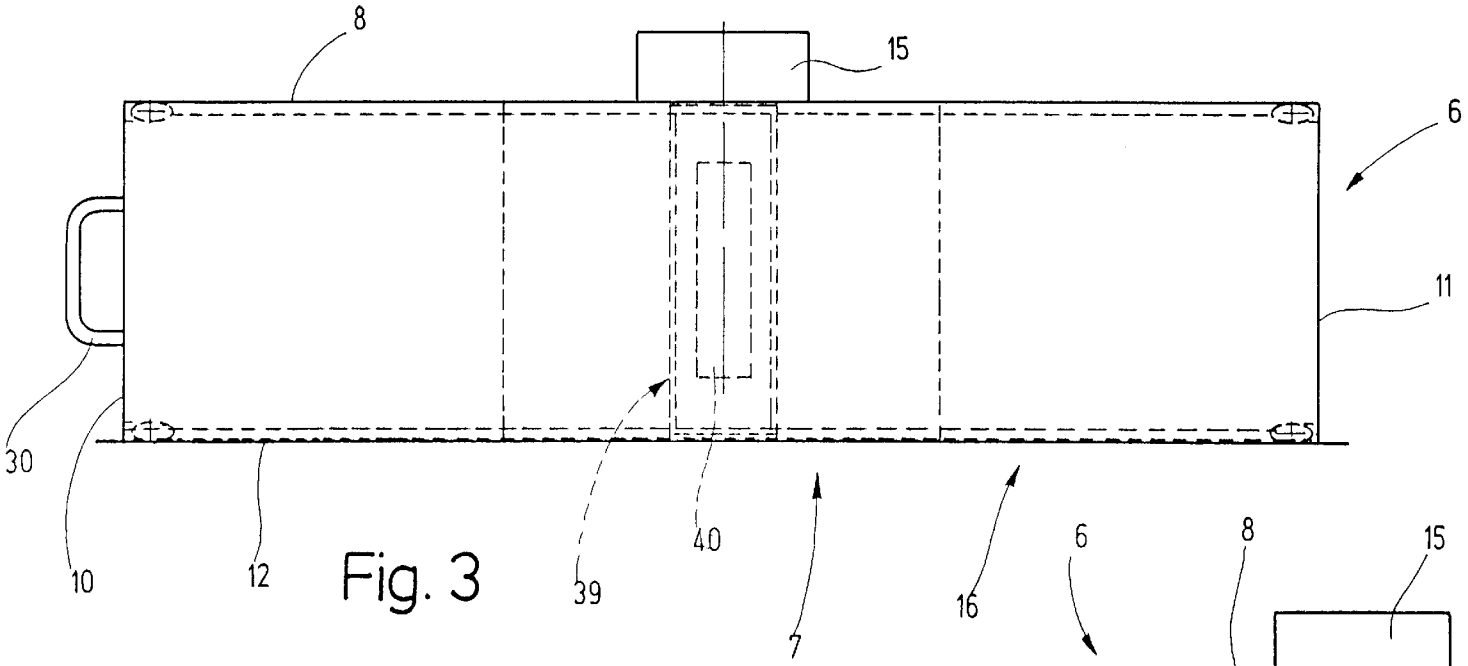
FIG. 3 is a side view of the air exhaust device.

In accordance with FIG. 2, each air exhaust device 6 can have a hood 21 associated with it which covers the exhaust zone. The hood 21 is preferably of U-shape, the cross piece of the U forming the top wall 22 and the legs of the U forming hood side walls 23 and 24. The top wall 22 is preferably aligned with the top wall 8 of the suction box 7, and the hood side walls 23 and 24 are aligned with the end walls 10 and 11 of the air exhaust device 6. By the dot-dash line in FIG. 1 it is indicated that the hood 21 is divided, in which connection the two halves of the hood can be swung around the parting line. Thus a corresponding axis of rotation is formed, with the result that one of the two hood halves can be swung up in each case so that in this way access to the rolls 4 is made possible. If a single U-shaped hood is concerned, it is taken off from the printing unit 1 in order to obtain access to the rolls 4.

The hood 21 preferably consists of a protective grid, the openings in the protective grid being so developed that not only is protection against contact provided but that an air guidance device is also produced by the hood walls. This means that the exhausting takes place in a well-defined manner and that essentially the space between the hood 21 and the two side walls 2 and 3 of the printing unit 1 is covered and less air present outside the hood 21 is drawn in.

FIGS. 3 to 7 show in greater detail the construction of the air exhaust device 6. From FIG. 5 it can be noted in particular that the air exhaust opening 14 is closed by an air filter 25. The air filter 25, which is developed as a filter mat 27, is replaceably received by a filter cartridge 26. The two end walls 10 and 11 of the suction box 7 are provided with bent tabs 28 in the region of the air exhaust opening 14, so that the filter cassette 26 provided with filter mat 27 can rest thereon. Furthermore, top wall 8 and bottom wall 12 are provided—in accordance with FIG. 4—with bends 29 so that a receiver is formed between the tabs 28 and the bends 29 for the filter cassette 26. The filter cassette 26 is provided on one end with a handle 30 by means of which insertion or removal in the lengthwise direction of the air exhaust device 6 can take place. For the fixing of the inserted position of the filter cassette 26 there are provided thumb screws 31 the threaded bolts of which are screwed into welded-on nuts on the bends 49 and which can pass through corresponding bore holes in the bends 29, whereby a clamping fast of the filter cassette is effected.

Figure 4:
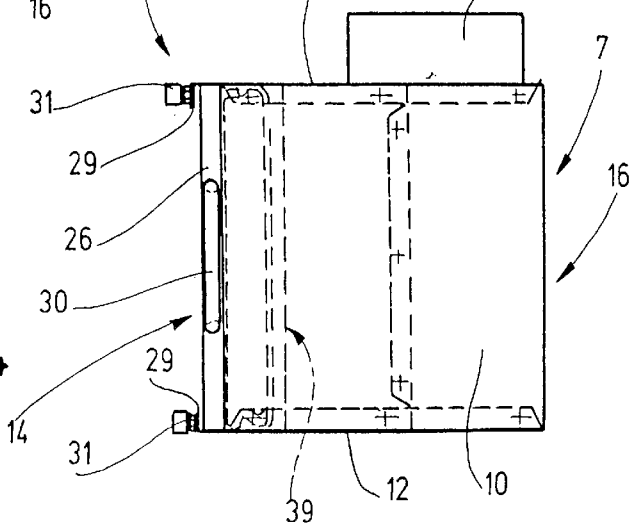
FIG. 4 is an end view of the air exhaust device of FIG. 3.
Figure 5:
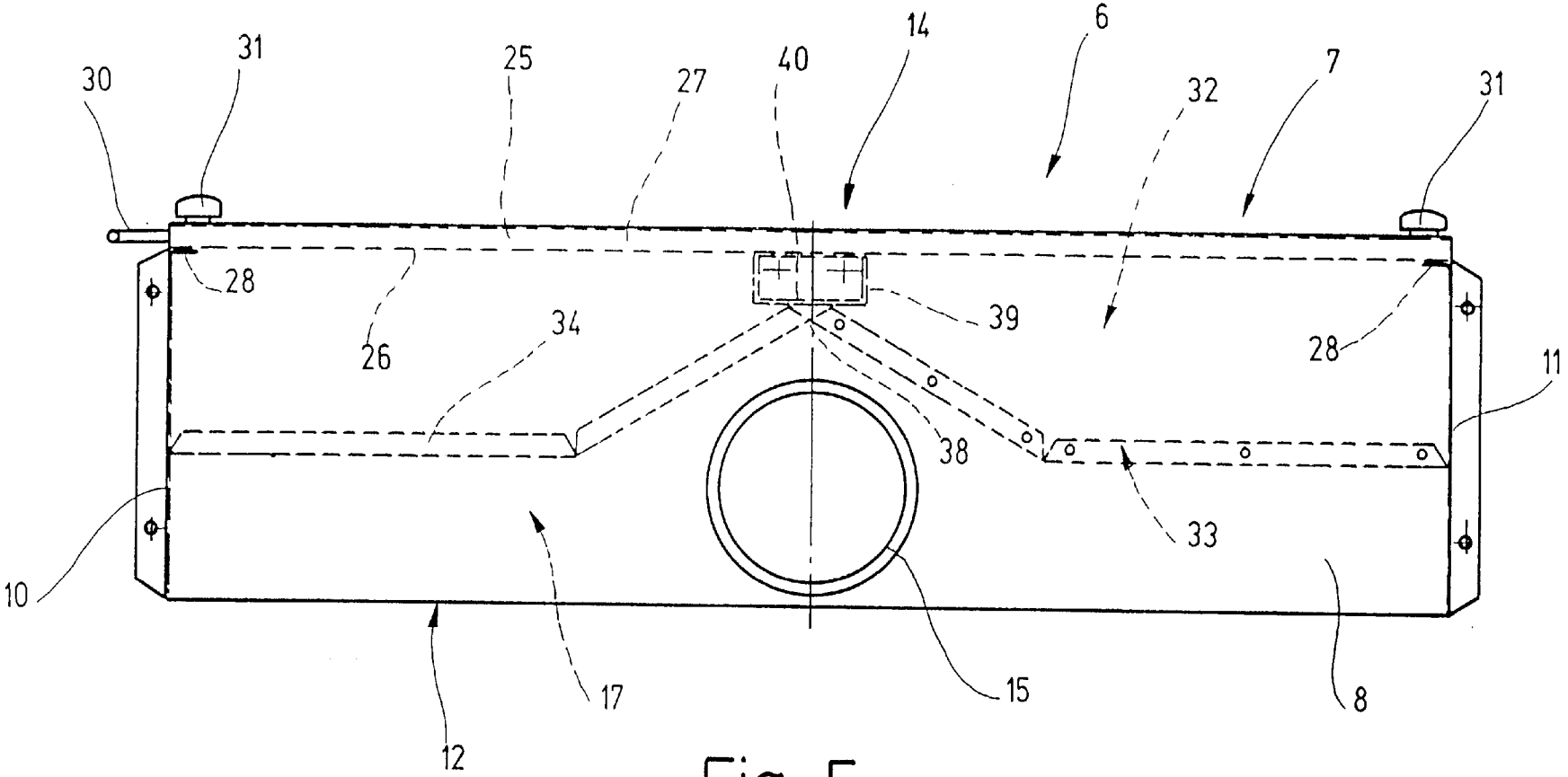
FIG. 5 is a top view of the air exhaust device of FIG. 3.
Figure 6:
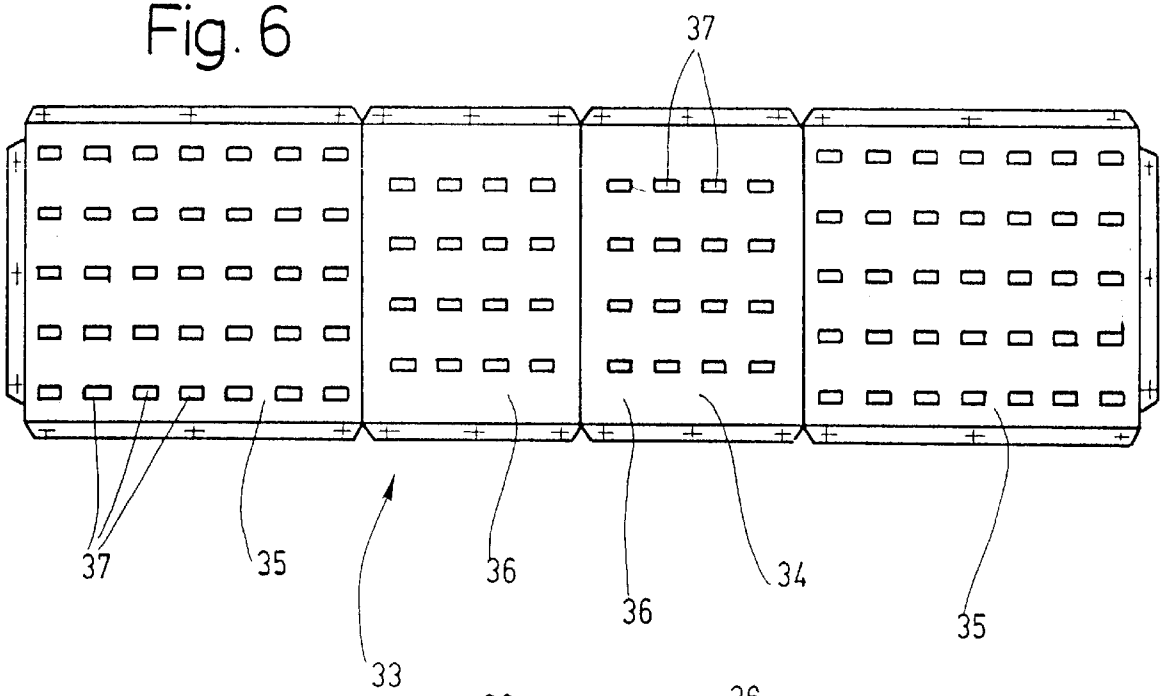
FIG. 6 is a perforated-plate arrangement of the air exhaust device.
Figure 7:
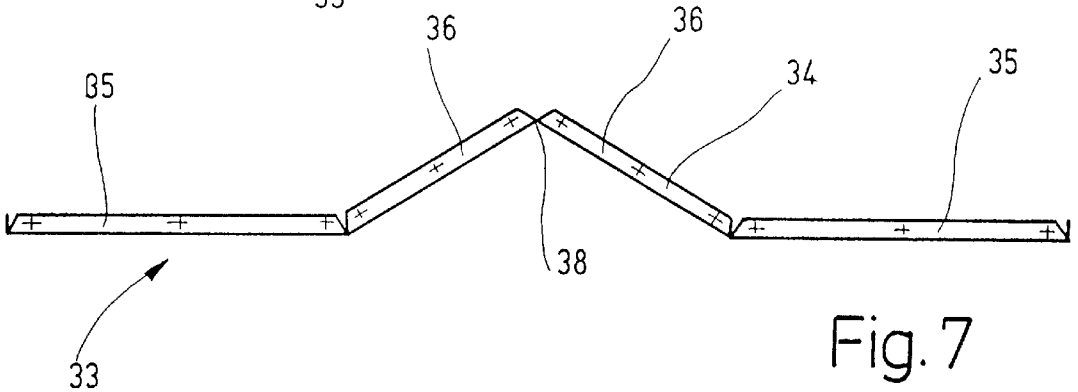
FIG. 7 is a top view of the arrangement of FIG. 6.

In the inside 32 of the air chamber 17 of the air exhaust device 6 there is a perforated-plate arrangement 33 in order to produce a drawing-off which is as uniform as possible. The perforated plate 34 of the perforated-plate arrangement 33 is shown in detail in FIGS. 6 and 7. It has a ridge-shaped bend (see FIG. 5) so that the pipe connection 15 comes to lie on the other side of the perforated plate 34. To this extent, two end walls 35 and two top walls 36 are developed on the perforated plate 34, the end walls 35 having a lower resistance to flow than the top walls 36. This can be attained for instance by the number of holes 37 in the perforated plate 34. It is also possible that, in addition or as an alternative, different cross sections of the holes 37 are selected. The perforated plate 34 is—as shown in FIG. 4—located at a distance from the air filter 25. Between the roof ridge 38 (FIG. 5) of the perforated plate 34 and the air filter 25 there is arranged—in vertical arrangement—a stiffening profile 39 between top wall 8 and bottom wall 12. It has a U-shaped cross section, the web of the U being passed through by an exhaust opening 40 (see also FIG. 1), so that a uniform withdrawal can take place.

In addition, there can be provided a pressure switch which measures the differential pressure on the two sides of the air filter 25 and—when a value is exceeded—gives off a signal in order to report a replacement of the filter mat 27. The change can be effected by simply pulling the filter cassette 26 out laterally. Due to the invention, there is a high air exchange rate in the exhaust space with at the same time low air velocities above the rolls 4 or the inking device of the printing unit 1. To this extent there is no danger of a draft. The protective grid has a two-fold function as air guidance plate and protection against contact. Due to the invention, the operator is in no way hindered, as at present in the prior art, by possible overlying hoods which are evacuated in upward direction, etc. Furthermore, there is no shower of fluff upon a change of filter, such as always takes place when the air filter 25 is above the rolls 4.

Figure 8:
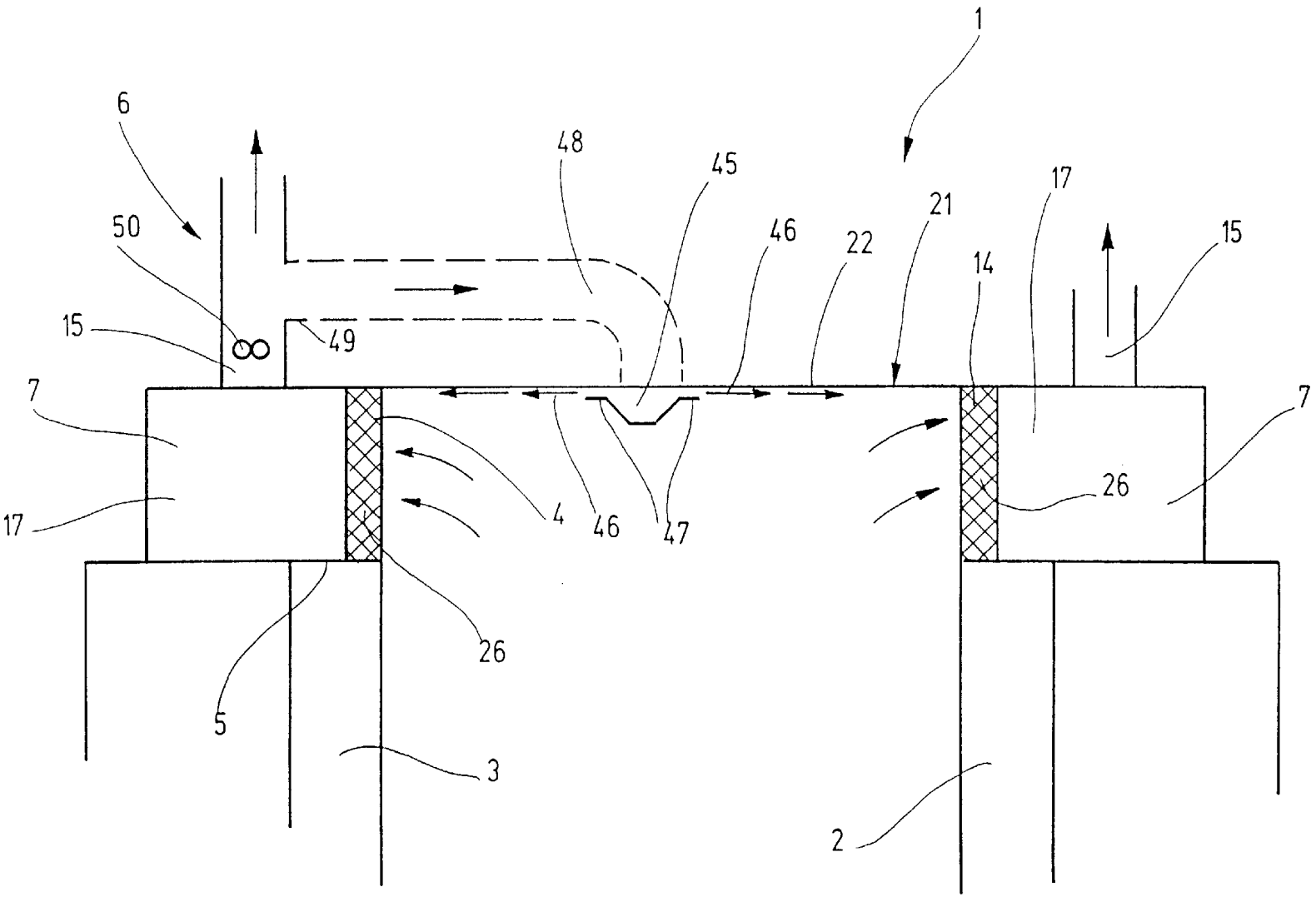
FIG. 8 shows an air exhaust device with hood with which at least one air curtain is associated.

FIG. 8 shows another embodiment which corresponds essentially to the embodiment of FIGS. 1 to 7, so that here only the differences need to be mentioned. They consist therein that the hood 21 has, associated with it, an air outlet 45 from which a curtain of air 46 emerges. The air curtain 46 passes along the inner side of the hood 21 and flows in the direction towards the air exhaust openings 14 of the two air chambers 17. The air outlet 45 preferably has slit-shaped outlet openings 47 each of which is directed towards the corresponding air exhaust opening 14. The air outlet 45 is preferably arranged in the center with respect to the width of the hood 21, in which connection the slit-shaped outlet openings 47 extend in particular—seen in the direction of printing of the printing machine—above the top wall 22 of the hood 21 and possibly also over the two hood side walls 23 and 24. The air curtain 46 emerging from the corresponding outlet opening 47 sees to it that the particles to be drawn off, particularly particles of ink, do not deposit on the inside of the hood 21, i.e. the hood 21 is kept clean of them. Thus, the corresponding air curtain 46 forms a barrier air curtain which applies itself preferably in accordance with the Coanda effect against the inside of the hood. The air outlet 45 is fed via an air duct 48 which—as shown in FIG. 8—is in communication with at least one of the pipe connections 15. Between the connection 49 of the air duct 48 on the pipe connection 15 which is thus formed and the corresponding suction box 7, there is a booster fan 50 which builds up a corresponding air pressure in the air duct 48 so as to feed the air outlet 45. Thus, exhaust air which has already been filtered and which arrives via the air exhaust opening 14 is used for the feeding. However, it is also possible for another source which is under pressure (not shown) to feed the air outlet 45. For the feeding, room air can for instance be fed from above or else from the side, as can already be noted from FIG. 8. Furthermore, room air is suitable as feed air to develop the air curtain 46.

If the hood 21 is perforated, and therefore developed for instance as air grid or the like, the development of at least one air curtain 46 is also advantageous, since the air curtain 46 acts in each case as drive jet and serves for the deflection of the exhaust air coming from the rolls 4 in order to conduct it in the direction towards the corresponding suction box 7.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A printing machine having an air exhaust device for removal of ink mist from the vicinity of printing rolls within the machine, the printing machine comprising:

rolls disposed within the printing machine;

a pair of side walls supporting the rolls; and an exhaust element disposed above at least one of the side walls and having an air suction opening at a location above the rolls and to a side of the rolls so that the suction opening of the exhaust element draws air in an approximately horizontal direction.

2. The printing machine of claim 1, wherein the printing machine includes a printing unit and the exhaust element is arranged so as to draw air from a vicinity adjacent the printing unit.

3. The printing machine of claim 1, wherein the exhaust element is located to one side of the rolls.

4. The printing machine of claim 3, wherein the printing unit includes a respective side wall to each side of the rolls of the printing unit, the exhaust element being located at a height above one of the side walls.

5. The printing machine of claim 4, wherein each side wall has an inner surface facing the other side wall and the suction opening to the exhaust element is approximately flush with the inner surface of the one side wall.

6. The printing machine of claim 4, wherein the exhaust element is positioned so as to not overlap the rolls of the printing unit, as seen from above.

7. The printing machine of claim 3, wherein the exhaust element is located at a height above the rolls.

8. The printing machine of claim 7, wherein the rolls extend along one direction and have ends; the exhaust element being in the region adjacent one end of the rolls.

9. The printing machine of claim 8, further comprising a second exhaust element, each exhaust element positioned in the region of one respective end of the rolls.

10. The printing machine of claim 9, further comprising a hood extending over the rolls of the machine and between the exhaust elements.

11. The printing machine of claim 10, wherein the hood has a top wall above the rolls and between the exhaust elements.

12. The printing machine of claim 11, wherein the hood is generally U-shaped, including a web of the U which forms the top wall and legs of the U forming side walls of the hood, the side walls extending along the longitudinal direction of the rolls and overlapping at least part of the arrangement of rolls in the vertical direction.

13. The printing machine of claim 8, wherein the printing machine includes a printing unit having an array of rolls having a direction, and the exhaust element is arranged with the printing unit such that the suction opening of the exhaust element extends over the entire length in the direction of the array of rolls in the printing unit.

14. The printing machine of claim 7, further comprising an air filter associated with the exhaust element for filtering air suctioned therethrough.

15. The printing machine of claim 14, wherein the air filter extends over the suction opening.

16. The printing machine of claim 15, further comprising an air chamber, wherein the suction opening comprises an open side of the air chamber.

17. The printing machine of claim 16, wherein the air filter defines and closes the open side of the air chamber.

18. The printing machine of claim 17, further comprising means for removably supporting the air filter to the air chamber, whereby the air filter is replaceable.

19. The printing machine of claim 18, wherein the air filter comprises a filter cassette at the air chamber and comprises a filter element replaceably inserted in the filter cassette.

20. The printing machine of claim 16, further comprising a perforated plate arrangement in the air chamber, with perforations for causing uniform removal of air through and along the air chamber.

21. The printing machine of claim 16, further comprising an upwardly extending suction line from the air chamber.

22. The printing machine of claim 7, wherein the exhaust element comprises an air chamber.

23. The printing machine of claim 7, further comprising a hood extending over the rolls of the machine and located inward over the rolls from the exhaust element.

24. The printing machine of claim 23, wherein the hood is shaped and positioned for defining an air flow guidance device.

25. The printing machine of claim 24, wherein the hood is formed of protective grid material, the grid material also exerting air guidance.

26. The printing machine of claim 24, further comprising the hood having an inner side toward the rolls, and means for forming an air curtain that blows along the inner side of the hood.

27. The printing machine of claim 26, wherein means for forming the air curtain delivers air inside the hood such that the air flow is substantially in the direction toward the suction opening and along the inside of the hood.

28. The printing machine of claim 7, wherein the exhaust element comprises an air chamber disposed in a side wall of the printing machine.

* * * * *